US008122726B2

(12) United States Patent
Tschirren et al.

(10) Patent No.: US 8,122,726 B2
(45) Date of Patent: Feb. 28, 2012

(54) COMBUSTION CHAMBER OF A COMBUSTION SYSTEM

(75) Inventors: Stefan Tschirren, Laufen (CH); Daniel Burri, Rothenburg (CH); Andreas Abdon, Zurich (CH); Christian Steinbach, Birmenstorf (CH)

(73) Assignee: Alstom Technology Ltd, Baden (CH)

( * ) Notice: Subject to any disclaimer, the term of this patent is extended or adjusted under 35 U.S.C. 154(b) by 460 days.

(21) Appl. No.: 12/367,997

(22) Filed: Feb. 9, 2009

(65) Prior Publication Data

US 2009/0202956 A1 Aug. 13, 2009

Related U.S. Application Data

(63) Continuation of application No. PCT/EP2007/056878, filed on Jul. 6, 2007.

(30) Foreign Application Priority Data

Aug. 7, 2006 (CH) ..... 1259/06

(51) Int. Cl.
*F02C 7/20* (2006.01)

(52) U.S. Cl. ..... 60/796; 60/752

(58) Field of Classification Search ..... 60/796, 60/752, 754–760

See application file for complete search history.

(56) References Cited

U.S. PATENT DOCUMENTS

| | | | | |
|---|---|---|---|---|
| 4,321,311 | A | 3/1982 | Strangman | |
| 5,083,424 | A | 1/1992 | Becker | |
| 5,431,020 | A | 7/1995 | Maghon | |
| 5,490,389 | A | 2/1996 | Harrison et al. | |
| 6,041,590 | A * | 3/2000 | Hayton et al. | 60/766 |
| 6,047,552 | A | 4/2000 | Gross et al. | |
| 6,276,142 | B1 | 8/2001 | Putz | |
| 6,675,586 | B2 | 1/2004 | Maghon | |
| 7,007,489 | B2 | 3/2006 | Schulten | |
| 7,779,637 | B2 * | 8/2010 | Heilos | 60/752 |
| 2003/0056515 | A1 | 3/2003 | Bast et al. | |

(Continued)

FOREIGN PATENT DOCUMENTS

DE 8618859 1/1998

(Continued)

OTHER PUBLICATIONS

International Search Report for International No. PCT/EP2007/056887 mailed on Mar. 4, 2003.

(Continued)

*Primary Examiner* — Louis Casaregola
*Assistant Examiner* — Andrew Nguyen
(74) *Attorney, Agent, or Firm* — Leydig, Voit & Mayer, Ltd.

(57) ABSTRACT

A combustion chamber of a combustion system has a combustion space, a support structure, a support element, and a heat shield. The heat shield has at least two segments, and each segment includes a liner element facing the combustion space and has an edge region, a gap communicating with the combustion space being formed between edge regions of adjacent segments, and a retaining device. The retaining device fixes the respective liner element on the support structure via the support element and forms a flange region that fits over the edge region of the respective liner element. The retaining device forms a first cooling passage with the support element and has at least one through-opening in the flange region. A cooling gas flows through the through.opening from the first cooling passage to the edge region.

11 Claims, 2 Drawing Sheets

U.S. PATENT DOCUMENTS

| | | | |
|---|---|---|---|
| 2004/0050060 | A1 | 3/2004 | Taut |
| 2004/0182085 | A1 | 9/2004 | Jeppel et al. |
| 2007/0245742 | A1 | 10/2007 | Dahlke et al. |
| 2009/0077974 | A1 | 3/2009 | Dahlke et al. |

FOREIGN PATENT DOCUMENTS

| | | |
|---|---|---|
| DE | 19727407 | 1/1999 |
| EP | 1022437 | 7/2000 |
| EP | 1143109 | 10/2001 |
| EP | 1477737 | 11/2004 |
| EP | 1507116 | 2/2005 |
| GB | 2298267 | 8/1996 |
| WO | WO-9813645 | 4/1998 |
| WO | WO 2006045758 A1 | 5/2006 |

OTHER PUBLICATIONS

Co-pending U.S. Appl. No. 12/367,908.

* cited by examiner

COMBUSTION CHAMBER OF A COMBUSTION SYSTEM

This application is a continuation of International Patent Application No. PCT/EP2007/056878, filed on Jul. 6, 2007, which claims priority to Swiss Patent Application No. CH 01259/06, filed on Aug. 7, 2006. The entire disclosure of both applications is incorporated by reference herein.

The invention refers to a combustion chamber of a combustion system, especially of a gas turbine, with a heat shield which has at least two segments.

BACKGROUND

Combustion chambers of a combustion system, for example of a gas turbine, are customarily equipped with a heat shield which protects a subjacent support structure against a direct contact with a hot gas flow. Depending upon position in the combustion chamber, or with regard to the hot gas flow, the heat shield, or individual segments of it, in this case is or are exposed to a variable temperature stress.

A nozzle segment for use in a gas turbine is known from EP 1 143 109 B1 and comprises a side wall, which extends essentially radially between a nozzle wall and a cover, and has an inwardly turned flange which is at a distance from the nozzle wall. The inwardly turned flange together with the nozzle wall and the side wall defines an undercut section, wherein a plurality of openings which lead through the inwardly turned flange are provided to allow cooling medium to flow into the undercut section for impingement cooling of the side wall. As a result of this, an essentially even cooling of the heat shield, or of the side wall, is achieved. The heat shield, depending upon position in the combustion chamber, is exposed to a temperature stress of variable degree, which for optimum cooling necessitates locally variable cooling.

SUMMARY OF THE INVENTION

The present invention provides an improved embodiment for a combustion chamber. The embodiment is especially characterized by a locally adapted cooling of a heat shield.

The invention is based on the general idea of designing a heat shield, which has at least two segments, with internal cooling passages so that locally variable cooling inside a segment is possible. In general, each segment in this case has a liner element, which faces a combustion space, and a retaining device, wherein the liner element is directly exposed to the hot gas flow and is fastened on a support structure via a support element. On the other hand, the retaining device, the liner element and the support element are fixed on the support structure. On the edge side, each liner element has an edge region which fits under a flange region of the retaining device which forms it. In this case, the individual segments are arranged next to each other so that a gap for thermal expansion, which is open towards the combustion chamber and into which hot gas can penetrate, remains between the edges of two adjacent liner elements. Therefore, in the case of the combustion chamber according to the invention it is provided that the retaining device together with the support element forms a first cooling passage in which flows cooling gas for cooling the liner element. For cooling the edge regions of the liner elements which face the gap, the retaining device, in the region of its flange region, has through-openings through which cooling gas flows from the first cooling passage to the edge region which is to be cooled and, depending upon configuration of the through-openings, enables a locally increased or decreased cooling of the edge region. Since the liner elements in the region of the gap do not completely reach as far as the support element or the support structure, hot gas which has penetrated into the gap can lead to an impairment of, or damage to, the support elements or the support structure. In order to counteract this, the through-holes are provided, which enable a calculated guiding of cooling gas from the first cooling passage to the edge region to be cooled, and as a result creates a requirement-oriented, locally defined cooling. As a result of the locally adapted cooling according to the invention, damage to, or impairment of, the support elements or the support structure can be avoided and consequently the service life of the combustion chamber can be increased. At the same time, maintenance cost is reduced, and as a result, lowering the operating costs can be achieved.

In an advantageous embodiment of the solution according to the invention, a distance between two through-openings, and/or a diameter of the through-openings, is adapted to a local cooling requirement. In the case of a high cooling requirement, it is therefore conceivable that a relatively small distance between two adjacent through-openings is selected, and/or a relatively large diameter of the through-openings is selected, whereas in the case of a rather low cooling requirement a larger distance between two through-openings can be selected, or a smaller diameter of the through-openings can be selected. This individual adaptation allows a requirement-oriented cooling of locally variably temperature-stressed regions and as a result also allows an improvement of the efficiency of the turbine since there are no excessively cooled regions which unnecessarily cool the hot gas flow.

One embodiment, in which an inner liner element is provided between the support structure and the liner element, and which together with the support structure forms a second cooling passage, or in which the liner element together with the inner liner element forms a third cooling passage, is especially advantageous. Such splitting into a plurality of cooling passages inside the heat shield allows an even more accurate controlling of the cooling of the heat shield, wherein the cooling gas first flows through the regions which are to be cooled more intensely, and then, after proportionate warming up, cool the regions which are to be cooled less intensely. As a result of this, cooling which is especially effective and also adapted to the necessary cooling requirement in each case can be carried out.

In a further advantageous embodiment, the pressure in the second cooling passage is greater than in the first cooling passage, and in the first cooling passage the pressure is greater than in the third cooling passage. As a result of this pressure drop, a controllable cooling flow can be created which, on account of the pressure difference, flows automatically through regions which are to be cooled in each case, and as a result saves a costly controlling of the cooling flows. The pressure difference between the individual cooling passages in this case can be controlled via a flow cross section of connecting passages which connect the individual passages, as a result of which influence can be brought to bear on the flow velocity at the same time.

Further important features and advantages of the combustion chamber according to the invention result from the claims, from the drawings, and from the associated figure description with reference to the drawings.

BRIEF DESCRIPTION OF THE DRAWINGS

Exemplary embodiments of the invention are shown in the drawings and are explained in more detail in the following description, wherein like designations refer to the same, or similar, or functionally the same components.

In this case, in the drawing, schematically in each case.

DETAILED DESCRIPTION OF THE EXEMPLARY EMBODIMENT

Figure 1:
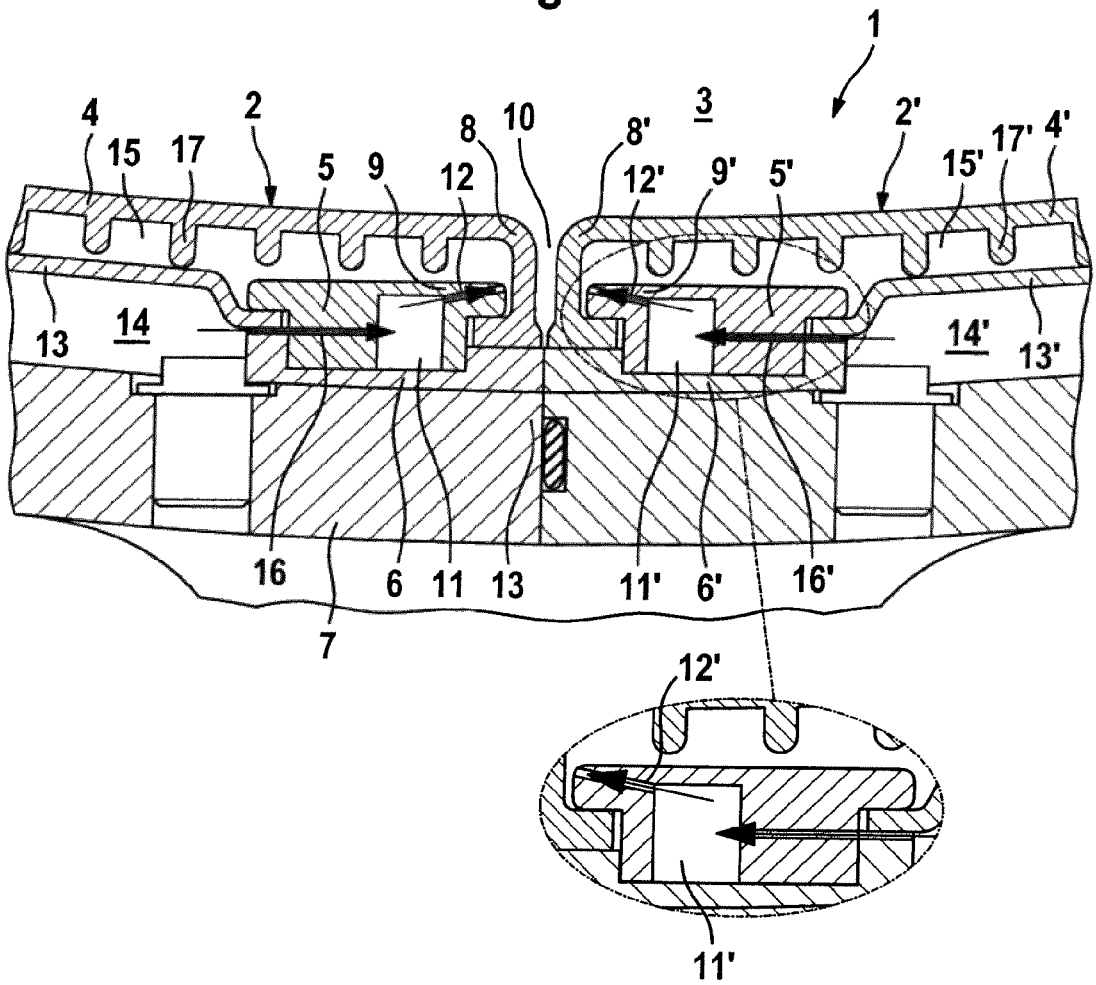
FIG. 1 shows a sectional view through a heat shield, according to the invention, of a combustion chamber.

In accordance with FIG. 1, a sectional view through a combustion chamber wall of a combustion system, especially of a gas turbine, is shown, with a heat shield 1 which has at least two segments 2 and 2' which are arranged next to each other. Each of the two segments 2 and 2' furthermore has a liner element 4, which faces a combustion space 3, and a retaining device 5. The liner element 4 in this case is formed from a material which is not affected by heat since it is in direct contact with hot gases which are present in the combustion space 3. The two liner elements 4 and 4' are fixed on a support structure 7 via a support element 6, wherein the retaining device 5 fixes both the liner element 4 and the support element 6 on the support structure 7. In this case, fastening of the liner element 4 on the retaining device 5 is carried out by means of an edge region 8 which is formed on the liner element 4 and fits in an undercut-like manner under a flange region 9 which is formed by the retaining device 5. On a side which faces away from the edge region 8 on the liner element side, fixing of an inner liner element 13 on the support element 6 via the retaining device 5 is carried out in the same way.

It is to be additionally gathered from FIG. 1 that a gap 10 for accommodating thermal expansions of the liner elements 4, 4', which is open towards the combustion space 3 and into which hot gas can also penetrate and lead to a high temperature stress there, remains between the two adjacent segments 2 and 2', especially between the two adjacent liner elements 4 and 4'. In particular, it is also conceivable that the hot gas which flows into the gap 10 acts on a gap base almost directly upon the support element 6 and can impair this with regard to its function. In order to be able to avoid such an impairment as result of hot gas flowing into the gap 10, or to be able to at least reduce such impairment, the invention proposes that the retaining device 5 together with the support element 6 forms a first cooling passage 11 and has through-openings 12 (cf. also FIG. 2) which are oriented towards the edge region 8 which is to be cooled so that cooling gas, especially cooling air, can flow from the first cooling passage 11 to the edge region 8 which is to be cooled and can cool this. The through-openings 12 in this case are provided in the region of the flange region 9 of the retaining device 5.

Figure 2:
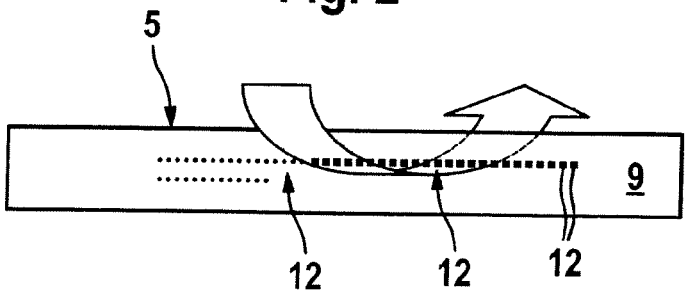
FIG. 2 shows a possible arrangement of through-openings between a first cooling passages and an edge region which is to be cooled.

In order to be able to adapt a cooling flow impingement which is required for cooling to necessary cooling capacities, a distance between two through-openings 12, and/or a diameter of the through-openings 12, can be varied. Such a variation is shown according to FIG. 2, from which it is evident that the through-openings 12 in a left-hand region have a significantly smaller diameter or cross section than in a right-hand region. As a result of this, with a uniform flow through the through-openings 12, a higher cooling capacity, or a higher cooling gas discharge from the through-openings 12, can be achieved in the right-hand region than in the left-hand region. If the necessary cooling capacity for the cooling requirement cannot be achieved with a single row of through-openings 12, which is shown in FIG. 2, then it is conceivable that a plurality of rows of through-openings 12, which extends parallel to the gap 10, is provided. As used herein, extending parallel to the gap shall mean that the row of through-openings extends parallel to, or essentially parallel to, the gap. A second row is indicated in this case according to FIG. 2.

As is to be additionally gathered from FIG. 1, an inner liner element 13, which together with the support structure 7 forms a second cooling passage 14, is provided between the support structure 7 and the liner element 4. On a side which faces away from the second cooling passage 14, the inner liner element 13 together with the liner element 4 forms a third cooling passage 15. In order to interconnect the individual cooling passages 11, 14 and 15, a connecting passage 16 is provided between the first cooling passage 11 and the second cooling passage 14. The through-openings 12 are arranged in turn between the first cooling passage 11 and the third cooling passage 15, which creates a connection between the two passages.

In order to now be able to create a cooling medium flow which is as continuous as possible in the individual passages 11, 14 and 15, it can be provided that the pressure in the second cooling passage 14 is greater than in the first cooling passage 11 so that cooling gas flows preferably continuously from the second cooling passage 14 into the first cooling passage 11 via the connecting passage 16. Furthermore, the pressure in the first cooling passage 11 should preferably be greater than in the third cooling passage 15 so that also in this case a continuous cooling gas flow takes place from the first cooling passage 11 into the third cooling passage 15 via the through-openings 12.

As a result of the arrangement of the individual cooling passages 11, 14 and 15 and also of the pressure distribution in these passages, a calculated cooling medium flow can be created, which is adapted to a local cooling requirement. In this way, the cooling gas in the second cooling passage 14 is still relatively cold and consequently cools the inner liner element 13. After passage of the cooling gas through the connecting passage 16 into the first cooling passage 11, the retaining device 5 is also cooled by the cooling gas flow. Afterwards, the cooling gas flow flows through the through-openings 12 to the edge region 8 on the liner element side and cools this before it flows further through the third cooling passage 15, which is arranged between the inner liner element 13 and the liner element 4, and there contributes to the cooling of the liner element 4. In this case, it is clear that the cooling gas is continuously warmed up, starting from the second cooling passage 14, via the first cooling passage 11, to the third cooling passage 14, so that an adequate cooling capacity in the third cooling passage 15 is promoted by arrangement of so-called cooling ribs 17. The cooling ribs 17 in this case are arranged on a side of the liner element 4 which faces away from the combustion space 3, and project into the third cooling passage 15. As a result of the enlargement of the surface, an improved cooling action is therefore carried out, as would be possible in the case of an embodiment without cooling ribs 17.

Figure 3:
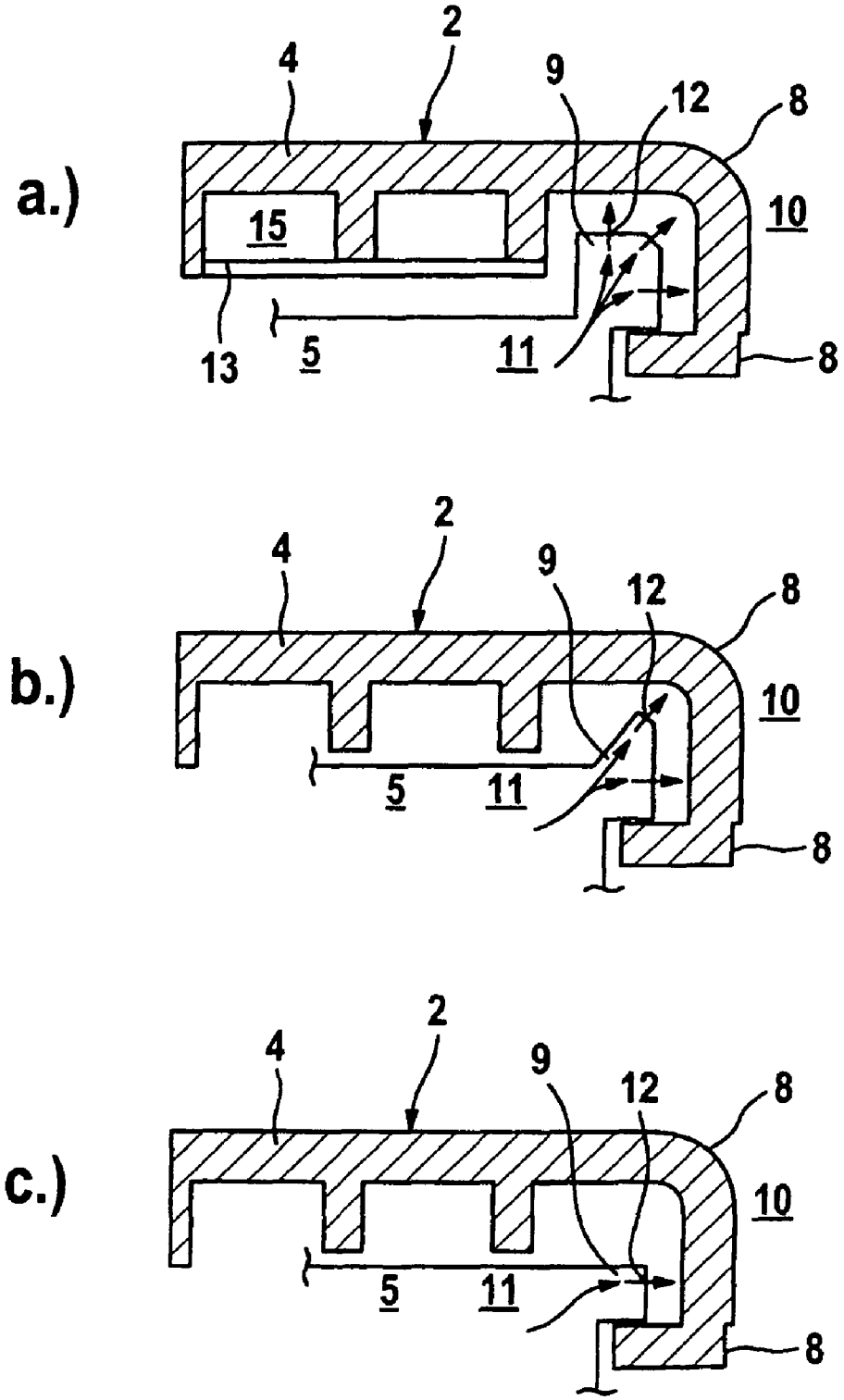
FIGS. 3*a*-3*c* show different arrangements of through-openings between the first cooling passage and the edge region which is to be cooled.

In FIG. 3, a plurality of conceivable embodiments of the flange region 9 of the retaining device 5 are now shown, wherein in FIG. 3*a* this has three rows of through-openings 12 and as a result achieves a particularly high cooling action on the facing edge region 8 of the liner element 4. In comparison to FIG. 3*a*, the flange region 9 of the retaining device 5 according to the FIG. 3*b* has only two rows of through-openings 12, as a result of which the cooling capacity which acts upon the edge region 8 is reduced. Once more, the cooling capacity can be reduced by the flange region 9 of the retaining device 5 having only one row of through-openings 12, as shown in FIG. 3*c*. The three different embodiments already show that depending upon the embodiment of the flange region 9 of the retaining device 5, or depending upon the arrangement of the through-openings 12, a different cooling capacity, which is individually adapted to a cooling requirement, can be achieved. The different rows of through-openings 12 in this case extend essentially perpendicularly to the plane of the figure, according to FIGS. 3*a* to 3*c*.

LIST OF DESIGNATIONS

1 Heat shield
2 Segments
3 Combustion space
4 Liner element
5 Retaining device
6 Support element
7 Support structure
8 Edge region of the liner element 4
9 Flange region of the retaining element 5
10 Gap between two liner elements 4
11 First cooling passage
12 Through-opening
13 Inner liner element
14 Second cooling passage
15 Third cooling passage
16 Connecting passage
17 Cooling rib

What is claimed is:

1. A combustion chamber of a combustion system, the combustion chamber comprising:

a combustion space;

a support structure;

a support element disposed on the support structure; and a heat shield with at least two segments, each segment including a liner element facing the combustion space and having an edge region, a gap communicating with the combustion space being formed between edge regions of adjacent segments, and each segment including a retaining device fixing the respective liner element on the support structure via the support element, each retaining device including a flange region that fits over a portion of the edge region of the respective liner element, the retaining device and support element forming a first cooling passage therebetween, the retaining device further having at least one through-opening extending through the flange region from the first cooling passage toward the edge region so as to provide a passage for a cooling gas flowing through the through-opening from the first cooling passage to the edge region.

2. The combustion chamber as recited in claim 1, wherein the at least one through-opening includes at least two through-openings and wherein at least one of a distance between the at least two through-openings and a diameter of the at least two through-openings is adapted to a local cooling requirement.

3. The combustion chamber as recited in claim 1, wherein each segment includes an inner liner element disposed between the support structure and the respective liner element, the inner liner element forming at least one of a second cooling passage with the support structure and a third cooling passage with the liner element.

4. The combustion chamber as recited in claim 3, wherein the inner liner elements forms the second cooling passage with the support structure, and further comprising at least one connecting passage between the first and second cooling passages.

5. The combustion chamber as recited in claim 3, wherein the inner liner elements forms the second cooling passage with the support structure, and wherein a pressure in the second cooling passage is greater than a pressure in the first cooling passage.

6. The combustion chamber as recited in claim 3, wherein the inner liner elements forms the third cooling passage with the liner element, and wherein a pressure in the first cooling passage is greater than a pressure in the third cooling passage.

7. The combustion chamber as recited in claim 1, wherein the at least one through-opening includes at least one row of through-openings extending parallel to the gap.

8. The combustion chamber as recited in claim 3, wherein the respective liner element has at least one cooling rib projecting into the third cooling passage.

9. The combustion chamber as recited in claim 3, wherein the respective retaining device fastens the respective inner liner element on the support element.

10. The combustion chamber as recited in claim 1; wherein the combustion system is a gas turbine.

11. A combustion system, comprising:

a combustion chamber that includes:

a combustion space;

a support structure;

a support element disposed on the support structure; and a heat shield with at least two segments, each segment including a liner element facing the combustion space and having an edge region, a gap communicating with the combustion space being formed between edge regions of adjacent segments, and each segment including a retaining device fixing the respective liner element on the support structure via the support element, each retaining device including a flange region that fits over a portion of the edge region of the respective liner element, the retaining device and support element forming a first cooling passage therebetween, the retaining device further having at least one through-opening extending through the flange region from the first cooling passage toward the edge region so as to provide a passage for a cooling gas flowing through the through-opening from the first cooling passage to the edge region.

* * * * *